US009761956B2

(12) United States Patent
Li et al.

(10) Patent No.: US 9,761,956 B2
(45) Date of Patent: Sep. 12, 2017

(54) ANTENNA SYSTEMS PROVIDING SIMULTANEOUSLY IDENTICAL MAIN BEAM RADIATION CHARACTERISTICS

(71) Applicant: Commsky Technologies, Inc., Santa Clara, CA (US)

(72) Inventors: Xin Li, HangZhou (CN); Po-shin Cheng, Fremont, CA (US); Daniel Wang, San Jose, CA (US); Jun Shen, Palo Alto, CA (US); George Zhao, Palo Alto, CA (US)

(73) Assignee: CommSky Technologies Corporation, Santa Clara, CA (US)

( * ) Notice: Subject to any disclaimer, the term of this patent is extended or adjusted under 35 U.S.C. 154(b) by 93 days.

(21) Appl. No.: 14/472,383

(22) Filed: Aug. 29, 2014

(65) Prior Publication Data

US 2014/0368404 A1 Dec. 18, 2014

Related U.S. Application Data

(63) Continuation-in-part of application No. 13/907,962, filed on Jun. 2, 2013.

(51) Int. Cl.

| | |
|---|---|
| ***H01Q 21/26*** | (2006.01) |
| ***H01Q 21/24*** | (2006.01) |
| ***H01Q 21/29*** | (2006.01) |
| ***H01Q 1/38*** | (2006.01) |
| ***H01Q 9/26*** | (2006.01) |
| ***H01Q 25/00*** | (2006.01) |

(52) U.S. Cl.

CPC ..... *H01Q 21/24* (2013.01); *H01Q 1/38* (2013.01); *H01Q 9/26* (2013.01); *H01Q 21/293* (2013.01); *H01Q 25/001* (2013.01)

(58) Field of Classification Search

CPC ..... H01Q 21/26
USPC ..... 343/797
See application file for complete search history.

(56) References Cited

U.S. PATENT DOCUMENTS

| | | | | |
|---|---|---|---|---|
| 6,310,584 | B1 * | 10/2001 | Reece | H01Q 9/285 343/725 |
| 2002/0084942 | A1 * | 7/2002 | Tsai | H01Q 21/26 343/795 |

* cited by examiner

*Primary Examiner* — Graham Smith
(74) *Attorney, Agent, or Firm* — Joe Zheng

(57) ABSTRACT

Techniques of designing an antenna array or antenna system are described. The antenna system includes a plurality of antenna units structured in a way to form a desired antenna pattern. According to one aspect of the present invention, each of the antenna units includes two antennas disposed orthogonally or in parallel. These antenna units are arranged in a pre-defined geometric pattern to create two substantially similar main beam radiation characteristics for independent polarizations.

18 Claims, 27 Drawing Sheets

Azimuth Pattern of the Antenna Shown in Fig. 1A

Azimuth Pattern of the Antenna Shown in Fig. 1B

Coupling between the traces on both sides of the PC board

Azimuth pattern of the vertically polarized antenna shown as part of the antenna unit in FIG. 2B Elevation pattern of the vertically polarized antenna as part of the antenna unit in FIG. 2B Azimuth pattern of the horizontally polarized antenna as part of the antenna unit in FIG. 2B Elevation pattern of the horizontally polarized antenna as part of the antenna unit in FIG. 2B Azimuth pattern of the vertically polarized antenna shown as part of the antenna unit in FIG. 2C Elevation pattern of the vertically polarized antenna as part of the antenna unit in FIG. 2C Azimuth pattern of the horizontally polarized antenna as part of the antenna unit in FIG. 2C Elevation pattern of the horizontally polarized antenna as part of the antenna unit in FIG. 2C

ANTENNA SYSTEMS PROVIDING SIMULTANEOUSLY IDENTICAL MAIN BEAM RADIATION CHARACTERISTICS

CROSS REFERENCE TO RELATED APPLICATIONS

This is a continuation-in-part of co-pending U.S. application Ser. No. 13/907,962, entitled "Antenna system providing simultaneously identical main beam radiation characteristics for independent polarizations", filed Jun. 2, 2013.

BACKGROUND OF THE INVENTION

Field of Invention

The invention generally is related to the area of antennas, and more particularly related to integrated antenna arrays structured in a way and controlled electronically to form a desired antenna pattern, wherein the desired antenna pattern can be controlled to demonstrate identical main beam radiation characteristics for independently polarized antennal elements.

Related Art

An antenna system is an indispensable component in communication systems. In conventional wireless communications, a single antenna is used at the source, and another single antenna is used at the destination. Physically, an antenna (or aerial) is an electrical device which converts electric power into radio frequency (RF) energy or waves, and vice versa. It is usually used with a radio transmitter or radio receiver. In transmission, a radio transmitter supplies an oscillating radio frequency electric current to the antenna, and the antenna radiates the energy from the current as electromagnetic waves (radio waves). In reception, an antenna intercepts some of the power of an electromagnetic wave in order to produce a tiny voltage to be supplied to a receiver to be amplified.

Antennas are essential components of all equipment that uses radio. They are used in systems such as radio broadcasting, broadcast television, two-way radio, communications receivers, radar, cell phones, and satellite communications, as well as other devices such as garage door openers, wireless microphones, Bluetooth enabled devices, wireless computer networks, baby monitors, and RFID tags on merchandise. Typically an antenna is an arrangement of metallic conductors and electrically connected (often through a transmission line) to a receiver or a transmitter. An oscillating current of electrons forced through the antenna by a transmitter creates an oscillating magnetic field around the antenna conductors, while the charge of the electrons also creates an oscillating electric field along the antenna conductors. These time-varying fields, when created in the proper proportions, radiate away from the antenna into space as a moving transverse electromagnetic field wave. Conversely, during reception, the oscillating electric and magnetic fields of an incoming radio wave exert force on the electrons in the antenna conductors, causing them to move back and forth, creating oscillating currents in the antenna.

It is well known that the RF energy radiated from an antenna system has its very unique polarization which depends on the geometry and the orientation of the antenna system. Typically, the polarization can be linear or elliptical. More specifically, linear polarization covers vertical polarization and horizontal polarization, and elliptical polarization covers circular polarization. Regardless, the very fundamental polarizations are vertical and horizontal polarizations. All other polarizations are simply the linear combinations of these two fundamental polarizations. For any transmission and reception of the RF energy, if the polarization of the transmitting antenna and the polarization of the receiving antenna do not line up, the RF energy would be lost, resulting in a weak RF link between two communicating devices.

In the Wi-Fi arena, the antenna systems at client ends are typically structurally simple and respond only to linearly polarized RF signals. Moreover, the orientations of the polarization at the client ends (e.g., a communicating device) are often unpredictable. It is therefore desirable for the Wi-Fi service providers to provide a system that is capable of offering both horizontally and vertically polarized RF links simultaneously for each individual channel in order to establish reliable respective RF links with the clients. Operationally, the clients can be best served when the main beam radiation characteristics of both the vertically polarized and the horizontally polarized RF energy are identical or substantially similar. Although it is not difficult to design an antenna system which provides both vertically polarized and horizontally polarized RF links, it is not trivial to provide both vertically polarized and horizontally polarized RF links that have the substantially similar main beam radiation characteristics.

One embodiment of the present invention is to provide designs of antennas that can provide both vertically polarized and horizontally polarized RF links that have substantially similar main beam radiation characteristics. With the compact designs, the antennas can be very well used for mobile devices for wireless communications.

SUMMARY OF THE INVENTION

This section is for the purpose of summarizing some aspects of the present invention and to briefly introduce some preferred embodiments. Simplifications or omissions in this section as well as in the abstract may be made to avoid obscuring the purpose of this section and the abstract. Such simplifications or omissions are not intended to limit the scope of the present invention.

The present invention generally pertains to designs of antenna arrays structured in a way to form a desired antenna pattern with substantially similar main beam radiation characteristics for both horizontally and vertically polarized RF links. According to one aspect of the present invention, the antenna arrays or an antenna system includes an array of antenna units. Each of the antenna units includes two antennas disposed orthogonally or in parallel disposed. These antenna units are arranged in a pre-defined geometric pattern to create two substantially similar main beam radiation characteristics for independent polarizations.

According to another aspect of the present invention, the antennas in an antenna unit are implemented on two printed circuit (PC) boards with metal (e.g., copper) strips etched thereon according to a predefined geometric design. Depending on implementation, each of the PC boards may have the metal strips on one side or both sides thereof. When there are metal strips or complete antennas on both sides of a PC board, they are coupled by a connection through the PC board.

According to still another aspect of the present invention, an antenna element includes a substrate (e.g., a PC board) with metal lines on one side and a set of metal elements on another side of the substrate, where the metal elements are provided to match a desired impedance (e.g., 50 ohms). When a plurality of such antennas are arranged in a predefined configuration, a desirable radiation pattern is formed to provide optimized links between an antenna system and respective clients.

According to still another aspect of the present invention, besides the metal strips for the antenna, a PC board is also used to support other circuits used to control the antenna thereon or for impedance matching. According to yet another aspect of the present invention, the antenna units in an array can be selectively energized to form a desired antenna pattern in accordance with a signal determined from radio signals communicated between a device equipped with the antenna system and another device (e.g., a Wi-Fi router in communication with a mobile device), where the desired antenna pattern provides an optimized antenna pattern to facilitate seamless or QoS communication between the two devices.

Depending on implementation, the present invention may be implemented as a method, an apparatus or part of a system. According to one embodiment, the present invention is an antenna system that comprises: a substrate; and a plurality of antenna units bonded to the substrate, each of the antenna units including a first printed circuit board and a second printed circuit board, wherein the first and the second printed circuit boards are disposed orthogonally or in parallel, each of the first and the second printed circuit boards includes metal strips etched on a first side according to a first predefined pattern and metal strips etched on a second side according to a first predefined pattern, wherein the first side and the second side is coupled by a connector going through the each of the first and the second printed circuit boards. The metal strips etched on the first side form two rounded halves, each of the halves having a metal strip going a certain pattern to form two enclosed loops and one channel between two segments of the metal strip.

According to another embodiment, the present invention is an antenna system that comprises: a substrate; and a plurality of antenna units arranged in a predefined geometric pattern and bonded to the substrate, each of the antenna units including a horizontally polarized antenna and a vertically polarized antenna, wherein either horizontally polarized antennas or vertically polarized antennas in the antenna units are energized, in accordance with a signal indicating a particular type of antenna a communication device is equipped with, to provide a better wireless link to the communication device communicating with an equipment employing the antenna system.

One of the objects, features and advantages of the present invention is to provide an antenna array or system that is amenable to small footprint, broad operating wavelength range, enhanced antenna pattern, lower cost, and easier manufacturing process. Other objects, features, benefits and advantages, together with the foregoing, are attained in the exercise of the invention in the following description and resulting in the embodiment illustrated in the accompanying drawings.

BRIEF DESCRIPTION OF THE FIGURES

These and other features, aspects, and advantages of the present invention will be better understood with regard to the following description, appended claims, and accompanying drawings where:

DETAILED DESCRIPTION OF THE INVENTION

The detailed description of the invention is presented largely in terms of procedures, steps, logic blocks, processing, and other symbolic representations that directly or indirectly resemble the operations of communication devices coupled to networks. These process descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments.

Further, the order of blocks in process flowcharts or diagrams representing one or more embodiments of the invention do not inherently indicate any particular order nor imply any limitations in the invention.

Service providers for wireless communication are looking for antenna systems that provide high power gain with small physical size. Further, it is desirable to deploy an antenna system that is capable of delivering optimal radio frequency (RF) power covering a known span of azimuthal angles. One embodiment of the present invention provides designs of antenna arrays structured in a way to form a desired antenna pattern with substantially similar main beam radiation characteristics for both horizontally and vertically polarized RF links.

Figure 1A:
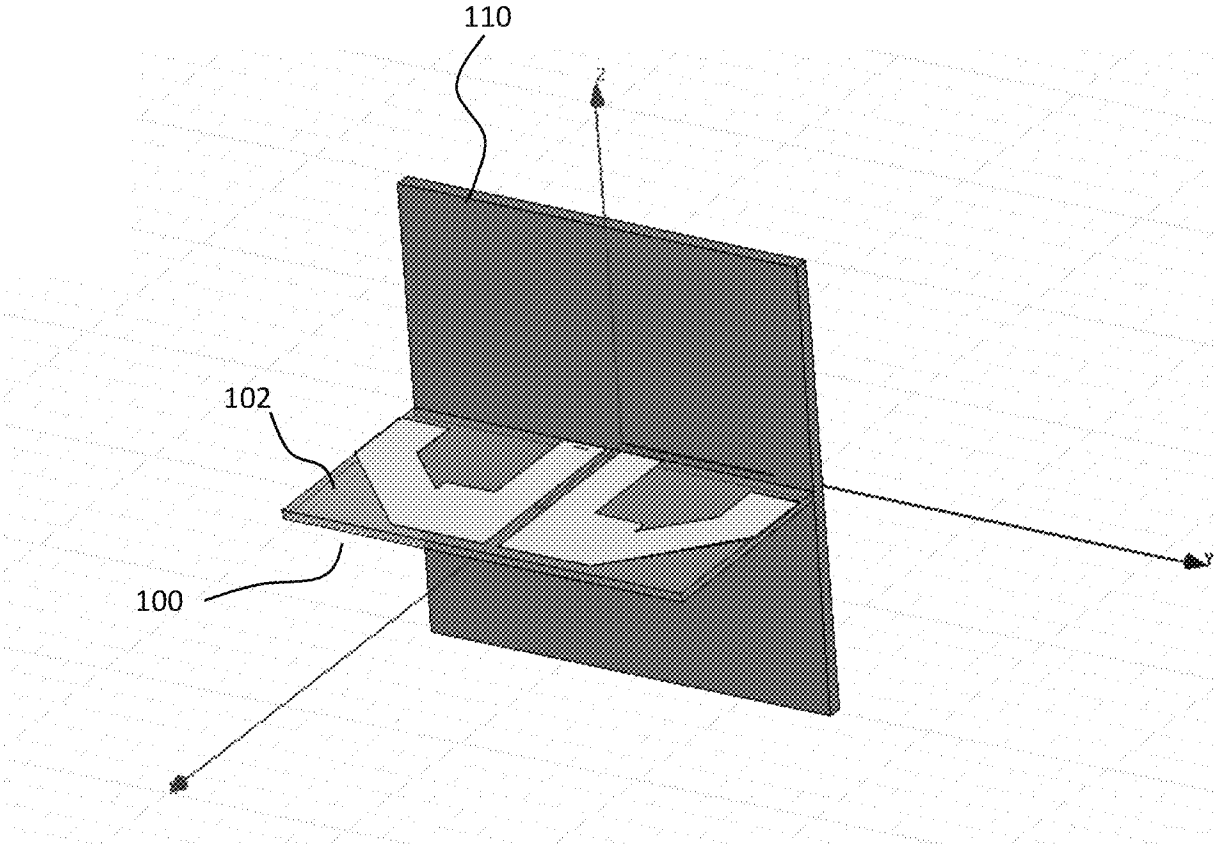
FIG. 1A shows a perspective view of an antenna element with metal (e.g., copper) conductors etched on a printed circuit board.
Figure 1B:
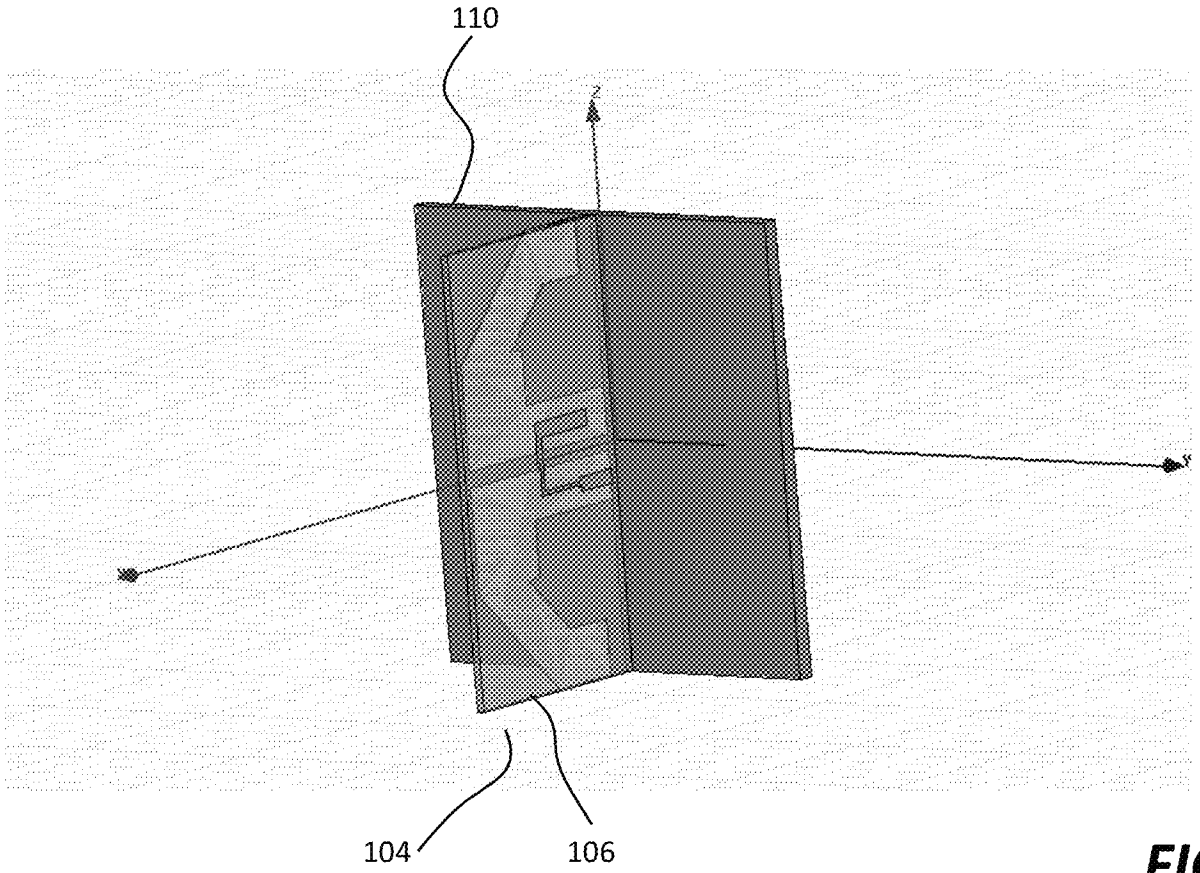
FIG. 1B shows a corresponding antenna element perceived as vertically mounted.

Referring now to the drawings, in which like numerals refer to like parts throughout the several views. According to one embodiment, FIG. 1A shows a perspective view of an antenna element 100 with metal (e.g., copper) conductors etched on a printed circuit board, PC board or PCB 102. The copper strips on one side of the PC board 102 can clearly be seen in the embodiment shown in FIG. 1A. Depending on implementation, the other side of the PC board 102 may also be used to have the copper strips arranged similar to that on the first side. The antenna element 100 is perceived as horizontally mounted in FIG. 1A. FIG. 1B shows a corresponding antenna element 104 perceived as vertically mounted.

According to one embodiment, the PC board 102 is double-sided. The copper trace on the other side of the PC board 102 is not visible in FIG. 1A but may be seen in FIG. 1B. In general, the copper strips on both sides of a PC board (e.g., the PC board 102) do not look similar. On one side of the PC board, it is an antenna element, such as an inverted "J" shape as shown in FIG. 1A or FIG. 1B, so it radiates when in transmission. On the other side of the PC board, the copper strips are serving as feed and impedance matching thus do not radiate when in transmission. Thus, the antenna on the PC board 102 or 106 is defined herein as an antenna element.

Figure 1C:
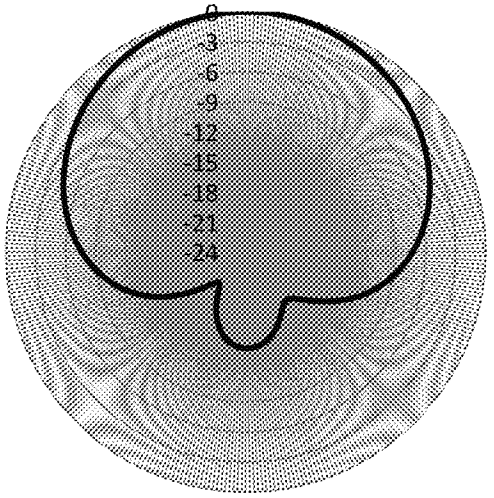
FIG. 1C and FIG. 1D respectively show corresponding horizontal and vertical radiation patterns of the antenna element shown in FIG. 1A and FIG. 1B.
Figure 1D:
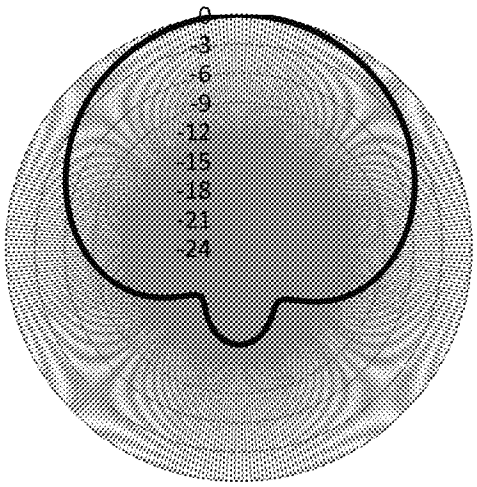

The PC board 102 is mounted perpendicularly on a metallic ground plane 110. The geometries of the copper strips and the size of the ground plane 110 are uniquely designed to achieve a desirable beam width in a horizontal plane. This horizontal plane is also known as the E-plane if the antenna element is oriented in the way as it is shown in FIG. 1A. The antenna element in FIG. 1B can be designed to achieve a desirable beam width in a horizontal plane, known as the H-plane if the antenna element is oriented in the way as it is shown in FIG. 1B. FIG. 1C and FIG. 1D respectively show horizontal radiation patterns of the antenna element shown in FIG. 1A and FIG. 1B. In other words, this basic antenna element in FIG. 1A or FIG. 1B offers substantially similar radiation characteristics in the horizontal plane. Furthermore, the antenna element shown in FIG. 1A and the antenna element shown in FIG. 1B are essentially identical. They are simply mounted in different orientations, one horizontally and the other one vertically. In other words, this basic antenna element essentially offers similar radiation characteristics in its E-pane and in its H-plane.

Figure 1E:
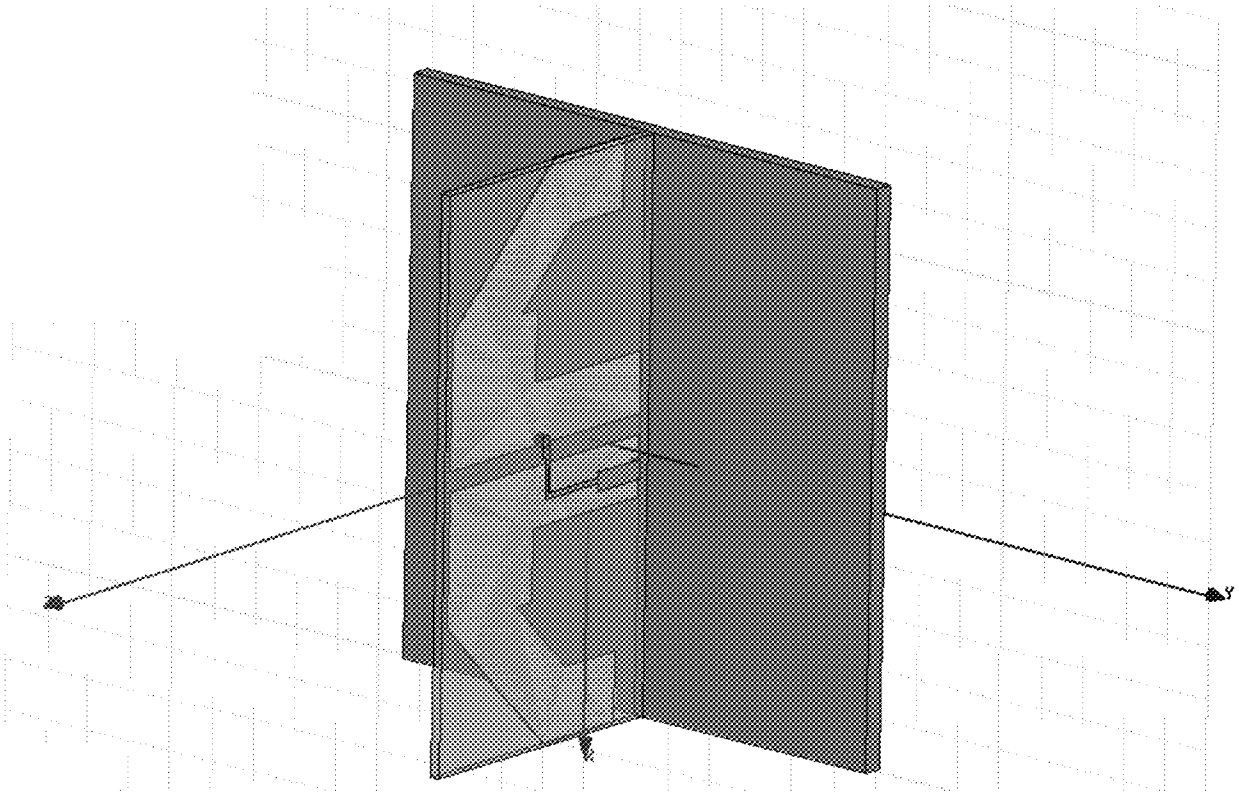
FIG. 1E shows that the RF energy can reach the inverted "J" through a coupling provided in a printed circuit board.

As it is shown in FIG. 1A, the copper strips on one side of the PC board 102 take the form of two inverted "J" shapes. FIG. 1B shows the copper strips on the other side of the PC board 106 with additional functions as a feed system and a circuit for impedance matching. The feed system follows the leg of one of the inverted "J" traces and crosses over to the leg of the other inverted "J" and couple the RF energy to the inverted "J" on the other side of the PC board 106. The RF energy can reach the inverted "J" through a direct connection as shown in FIG. 1E.

Figure 2A:
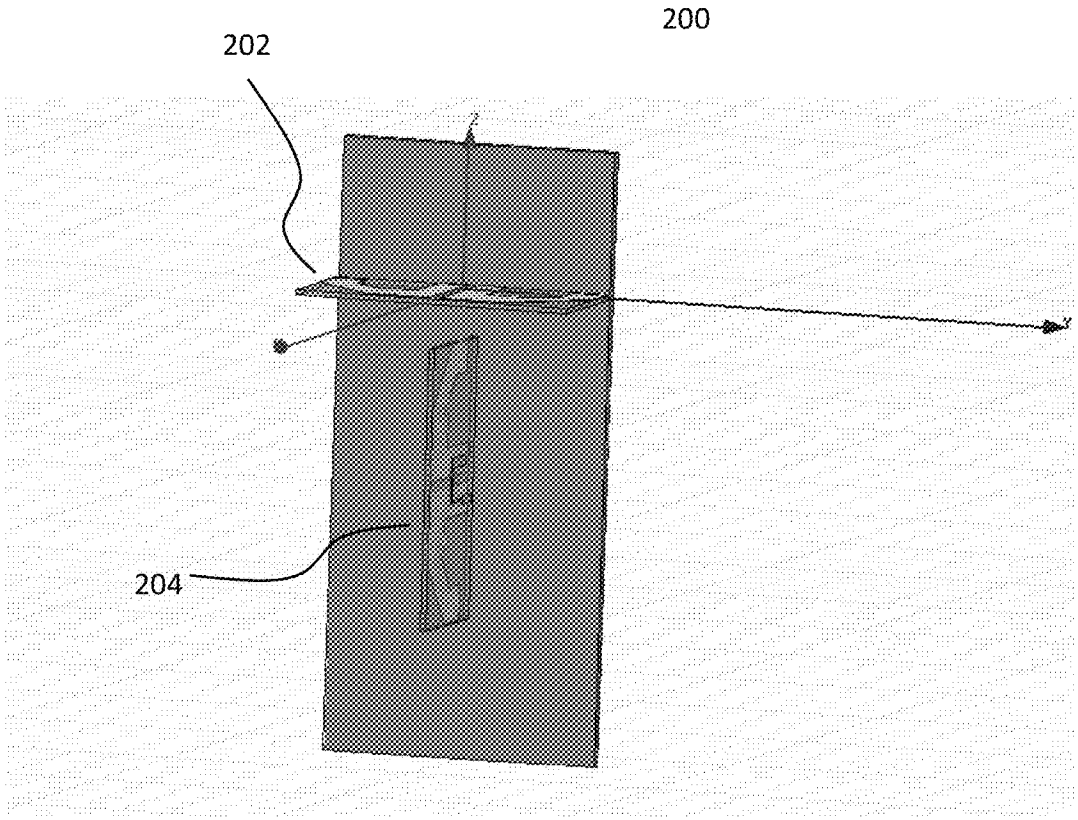
FIG. 2A shows an exemplary embodiment of the present invention using the basic antenna elements of FIG. 1A and FIG. 1B to structure an antenna unit configured to provide both vertically polarized and horizontally polarized RF links that have substantially similar main beam radiation characteristics.

Referring now to FIG. 2A, it shows an exemplary embodiment of the present invention using the basic antenna elements shown in FIG. 1A and FIG. 1B to structure an antenna unit 200 configured to provide both vertically polarized and horizontally polarized RF links that have substantially similar main beam radiation characteristics. As shown in FIG. 2A, two antenna elements 202 and 204 are isolated from each other as far as the RF energy is concerned. In other words, these two antenna elements 202 and 204 can function independently and provide both vertically polarized and horizontally polarized RF links simultaneously, where the main beam radiation characteristics for each of the RF links is substantially similar.

Figure 2B:
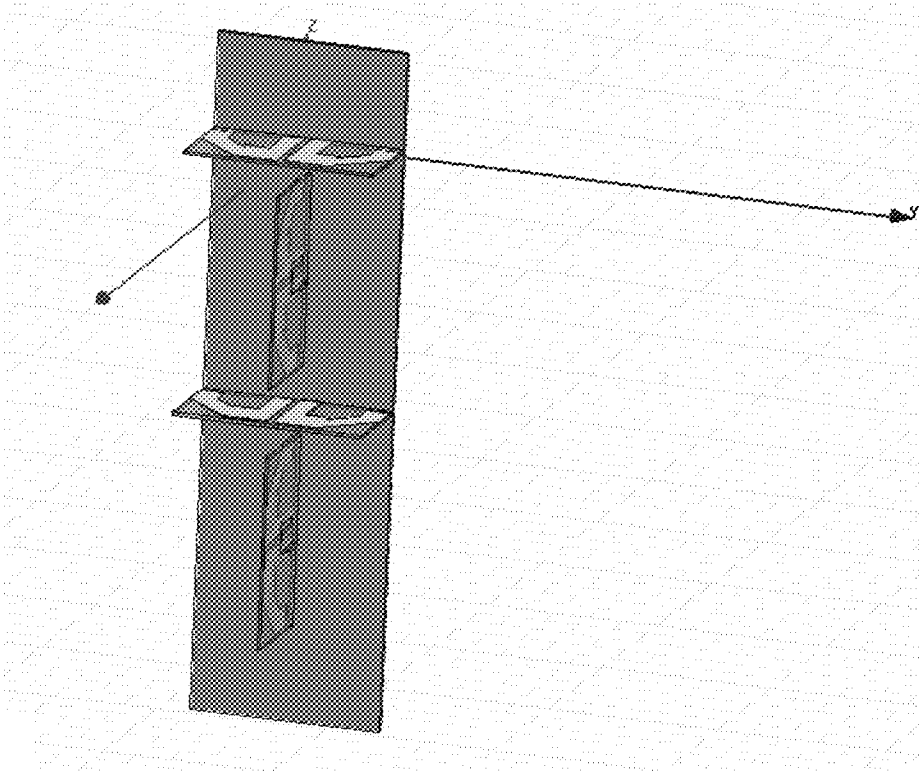
FIG. 2B shows that two antenna units are arranged vertically or one on top of the other with an equal space between them.
Figure 2C:
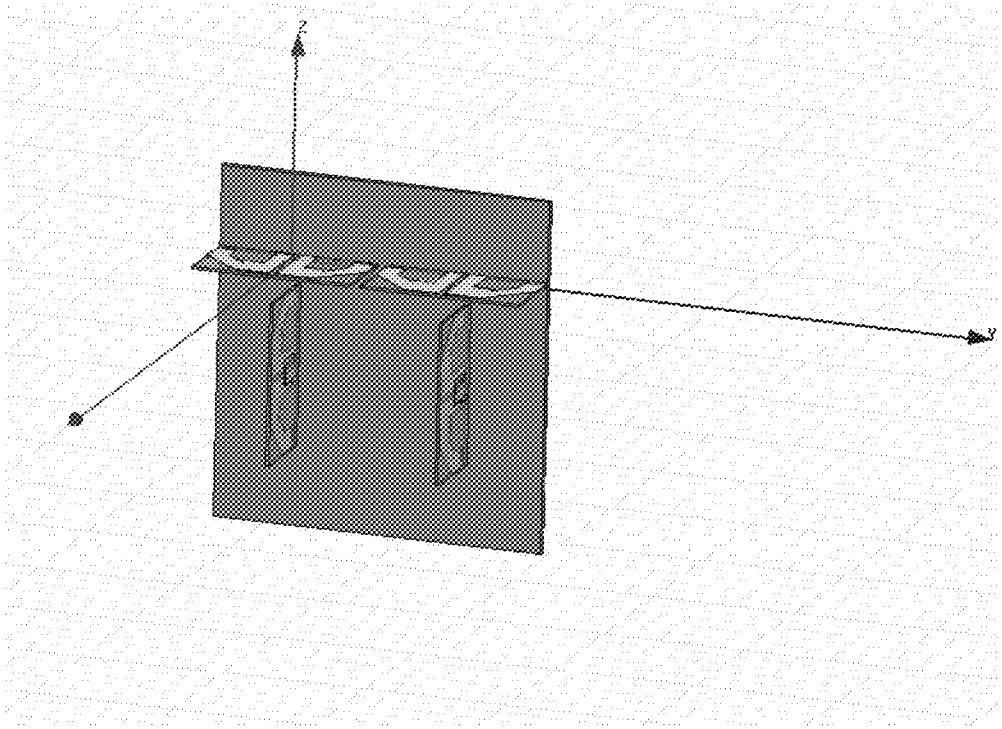
FIG. 2C shows that two antenna units are arranged horizontally or next to each other.
Figure 2D:
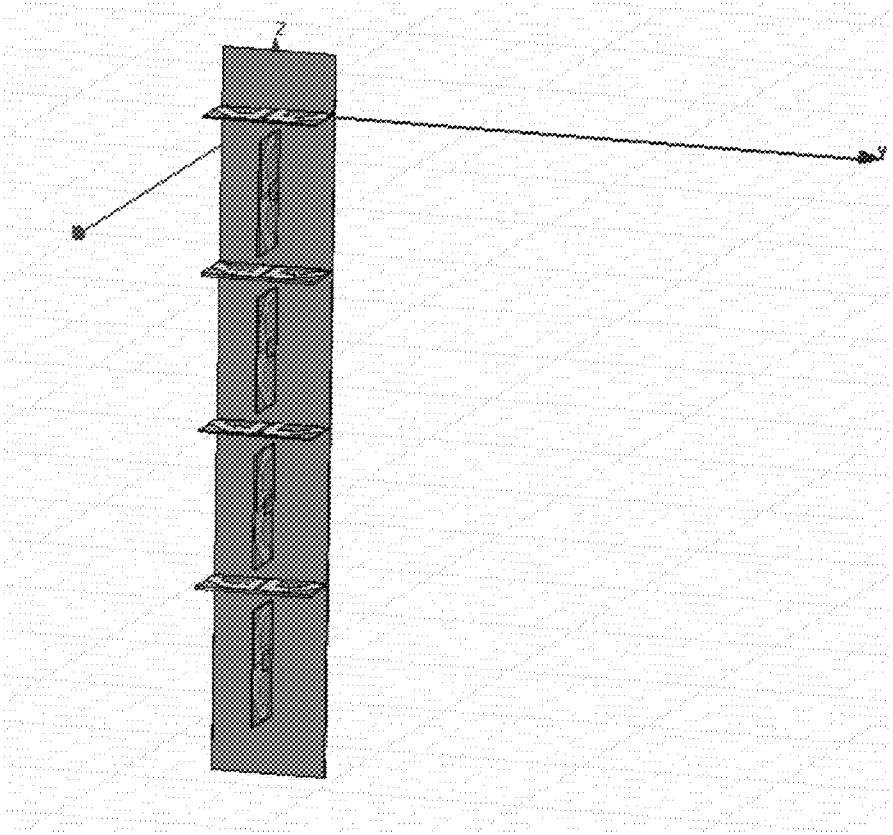
FIG. 2D, FIG. 2E, FIG. 2F, FIG. 2G, and FIG. 2H shows respectively some additional exemplary structures using more such antenna units.
Figure 2E:
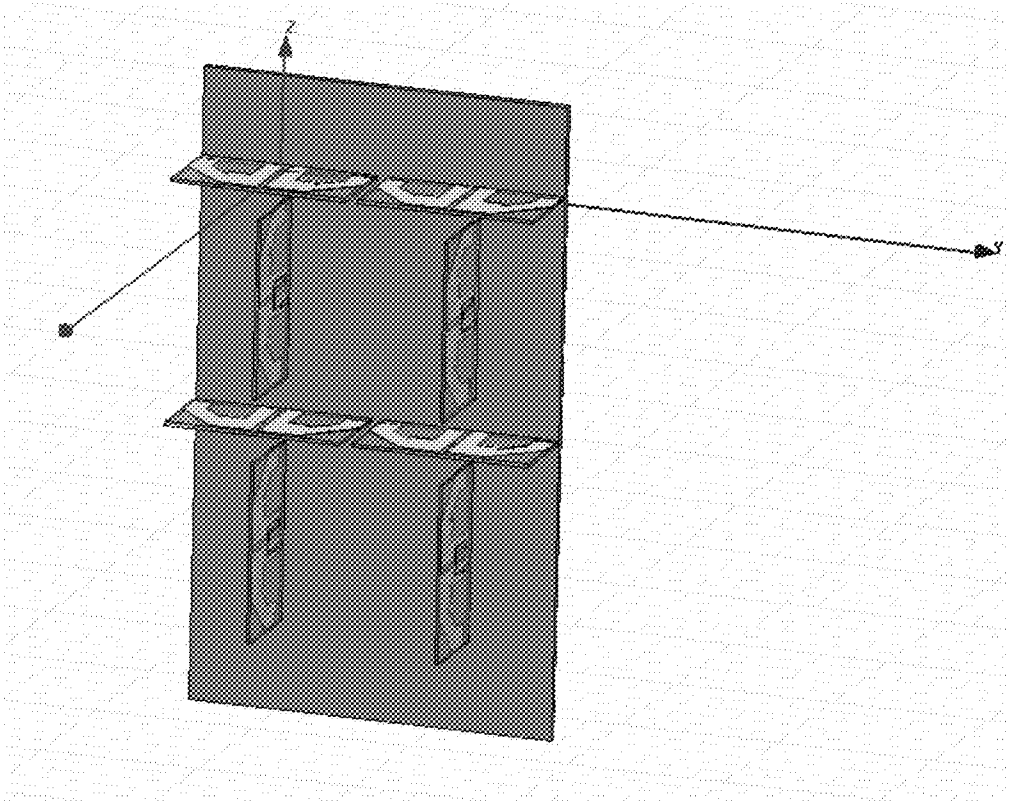
Figure 2F:
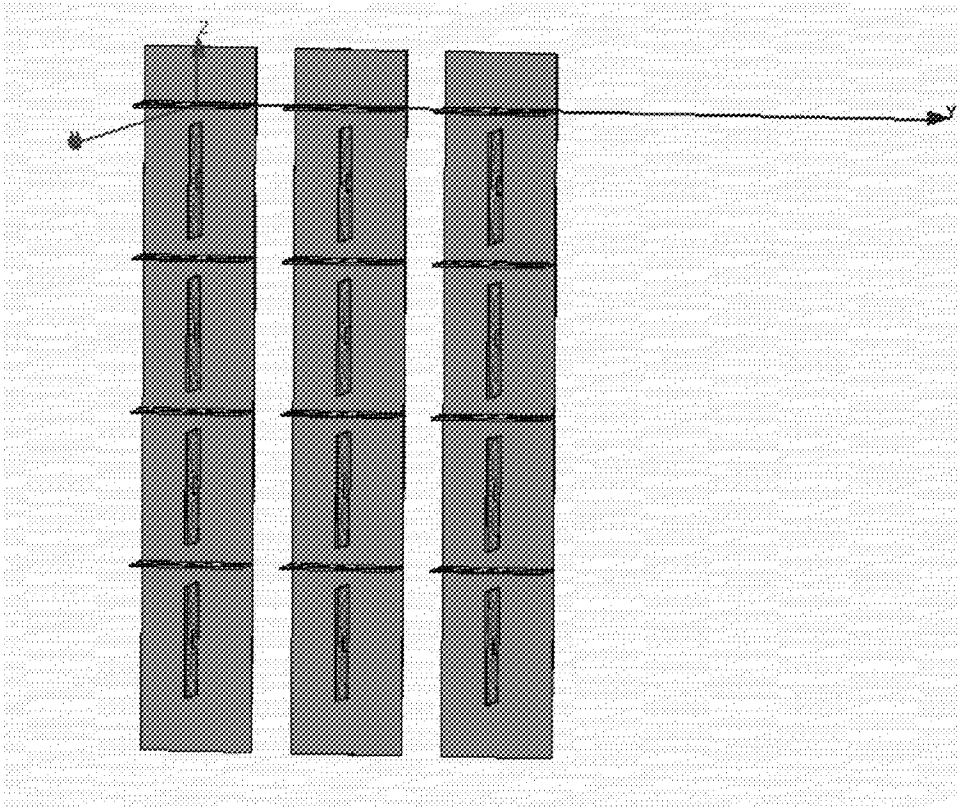
Figure 2G:
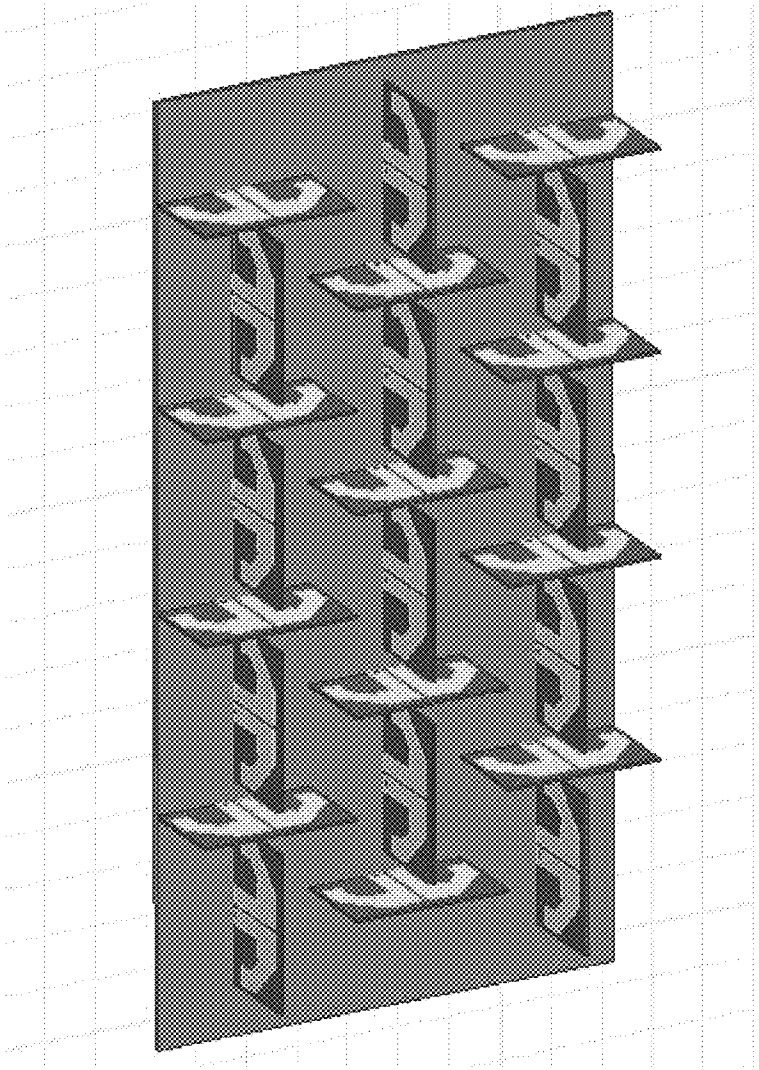
Figure 2H:
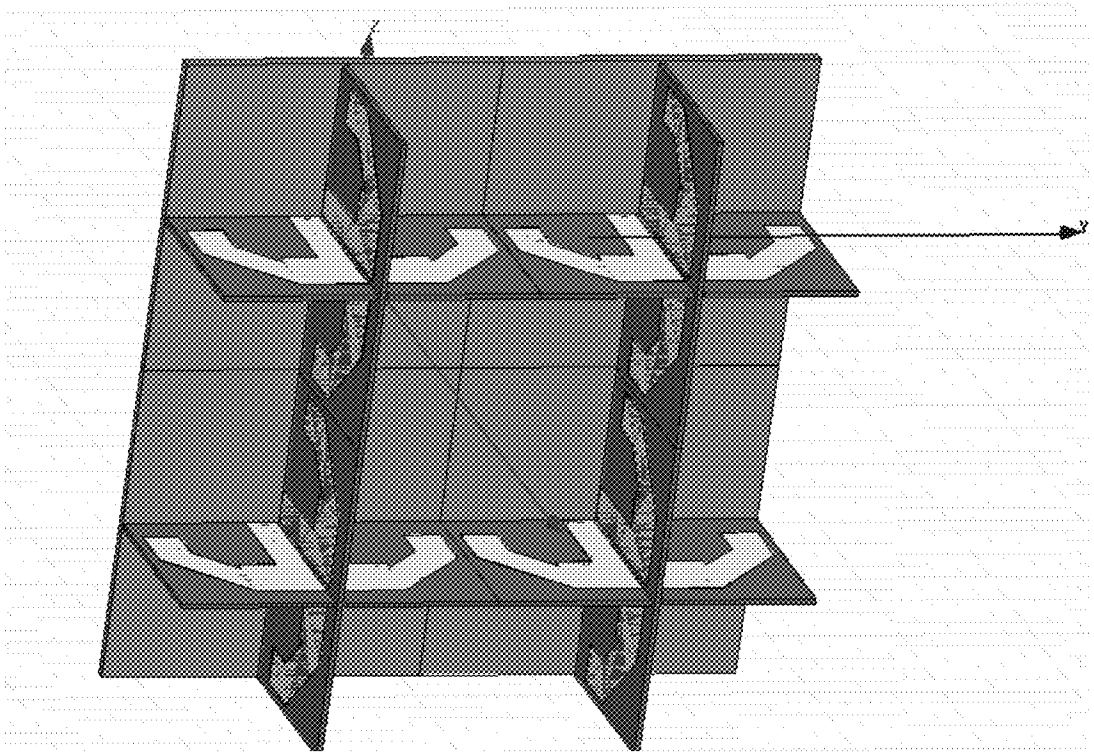
Figure 2I:
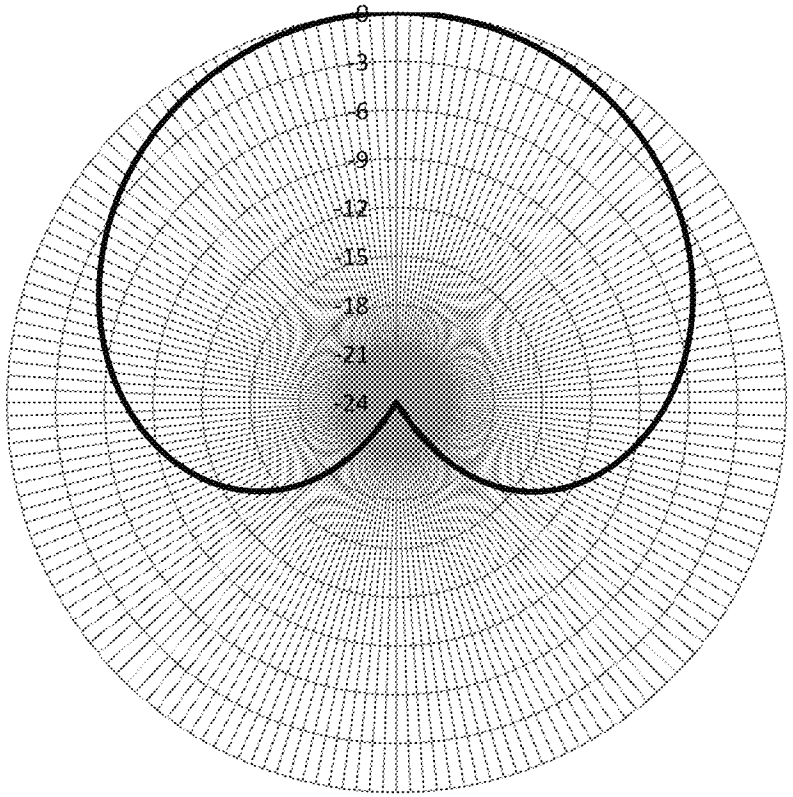
FIG. 2I-FIG. 2L show respectively the radiation patterns of the antenna (unit) as shown in FIG. 2B.
Figure 2J:
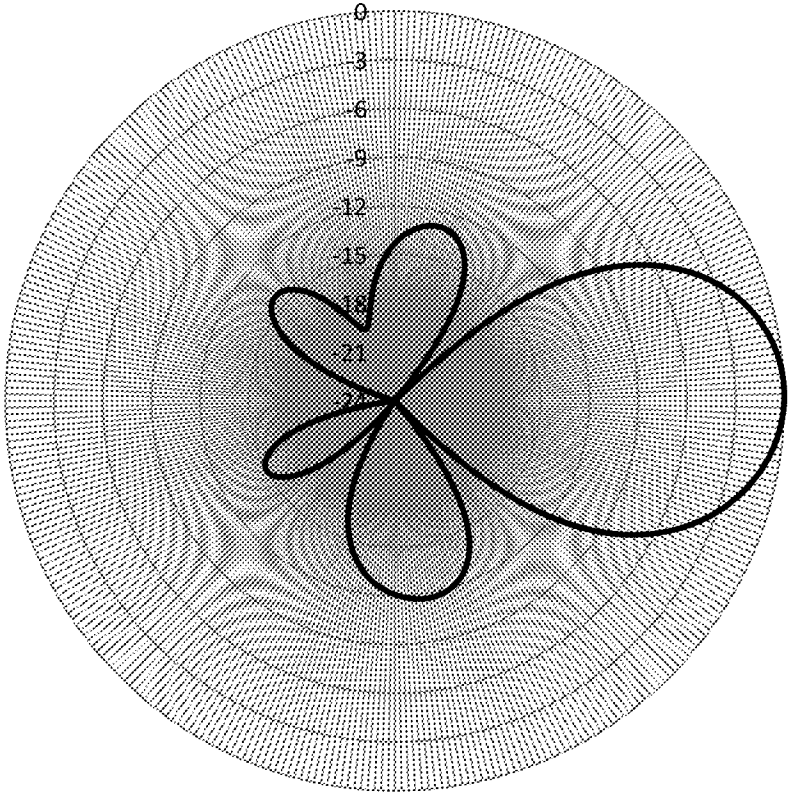
Figure 2K:
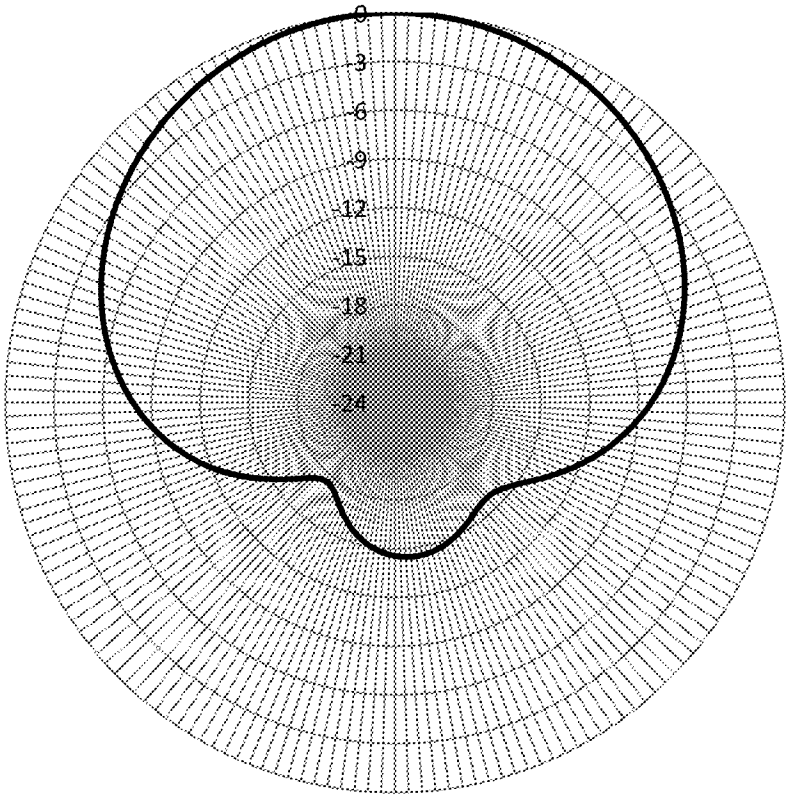
Figure 2L:
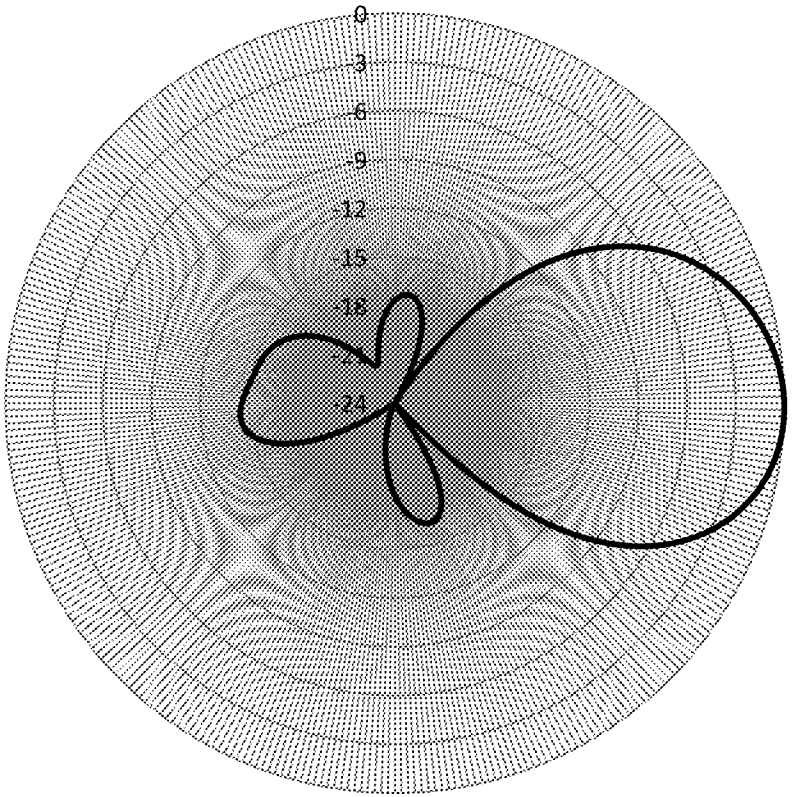
Figure 2M:
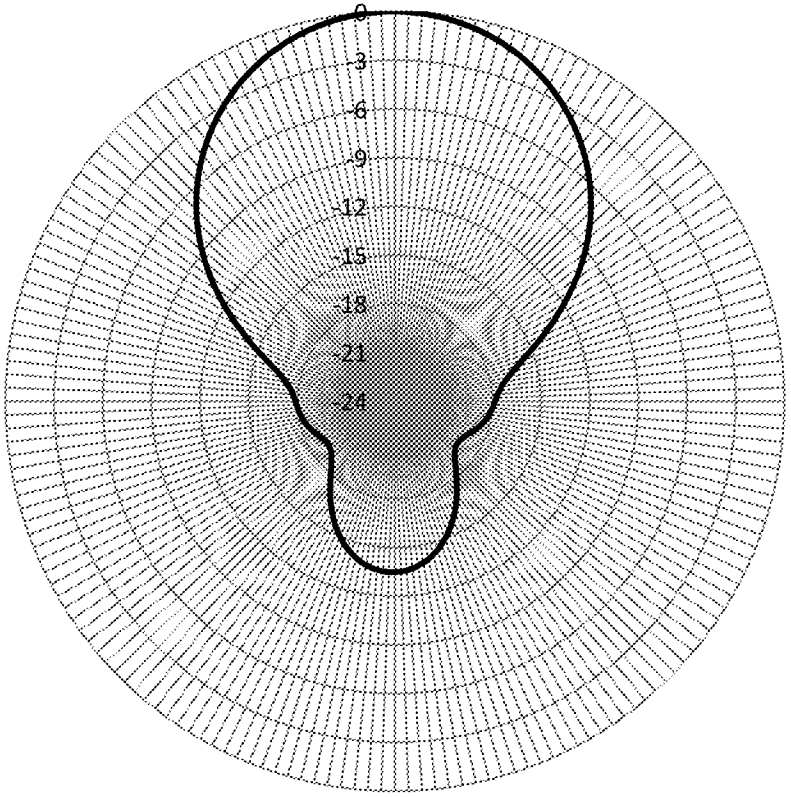
FIG. 2M-FIG. 2P show respectively the radiation patterns of the antenna (unit) as shown in FIG. 2C.
Figure 2N:
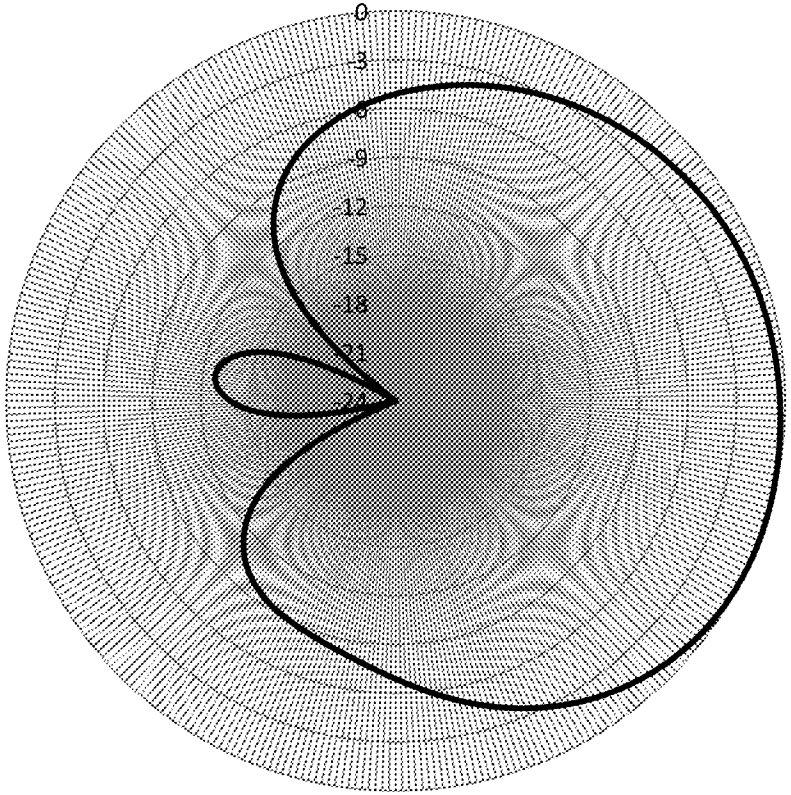
Figure 2O:
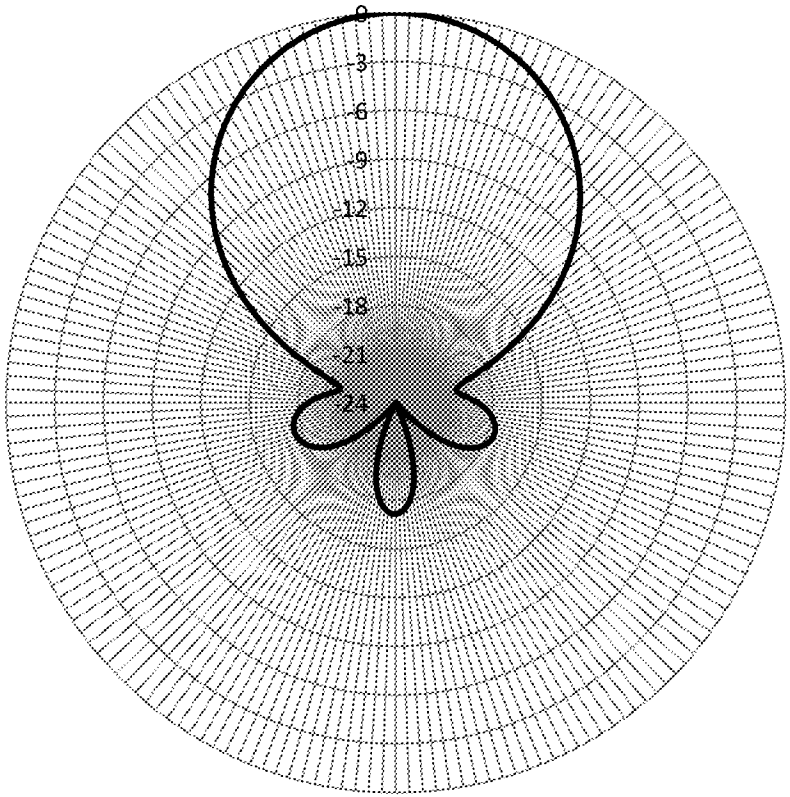
Figure 2P:
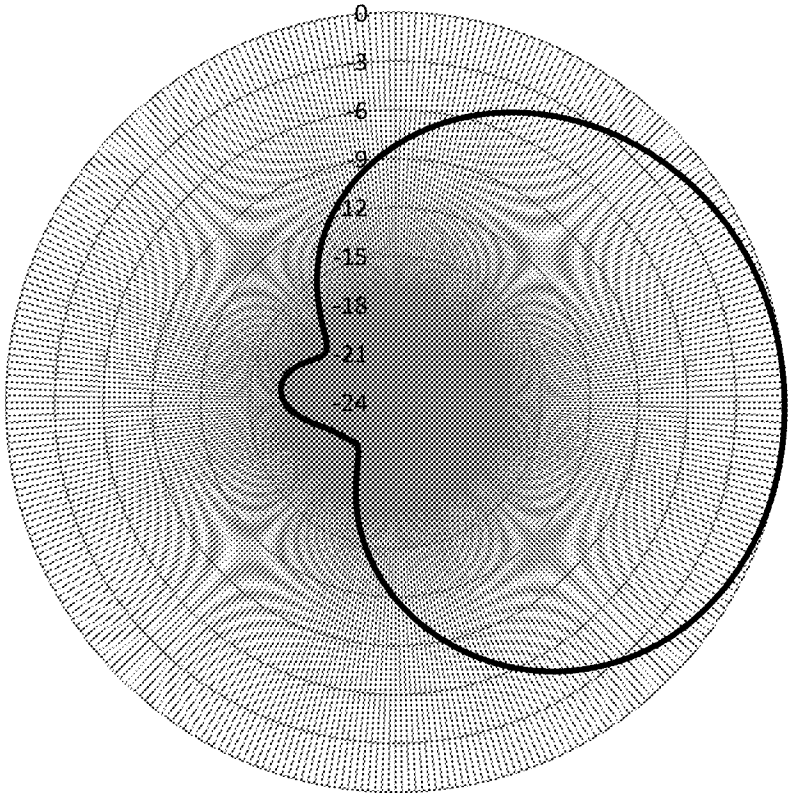

FIG. 2B shows that two antenna units are arranged vertically or one on top of the other. FIG. 2C shows that two antenna units are arranged horizontally or next to each other. Multiple such antenna units may be arranged differently. FIG. 2D, FIG. 2E, FIG. 2F, FIG. 2G, and FIG. 2H shows respectively some additional exemplary structures using more such antenna units. Those skilled in the art shall come up with additional structure based on the symmetric arrangement to form different antenna systems given the detailed description of the present invention herein.

Nevertheless, in all the possible configurations, the antenna units can be horizontally or vertically stacked or arrayed to function as one antenna system. According to one embodiment, all the antenna elements that are vertically arranged can be arrayed together and function as one antenna unit, and all the antenna elements that are horizontally arranged can be arrayed together and function as another antenna unit. In any case, the antenna units or arrays are fully independent from each other and provide both vertically polarized and horizontally polarized RF links that have substantially similar main beam radiation characteristics.

FIG. 2I-FIG. 2L show respectively the radiation patterns of the antenna (unit) as shown in FIG. 2B. FIG. 2M-FIG. 2P show respectively the radiation patterns of the antenna (unit) as shown in FIG. 2C. These figures clearly demonstrate that the main beam radiations provided by the vertically polarized antenna unit and the horizontally polarized antenna unit are substantially similar.

Figures 3A, 3B:
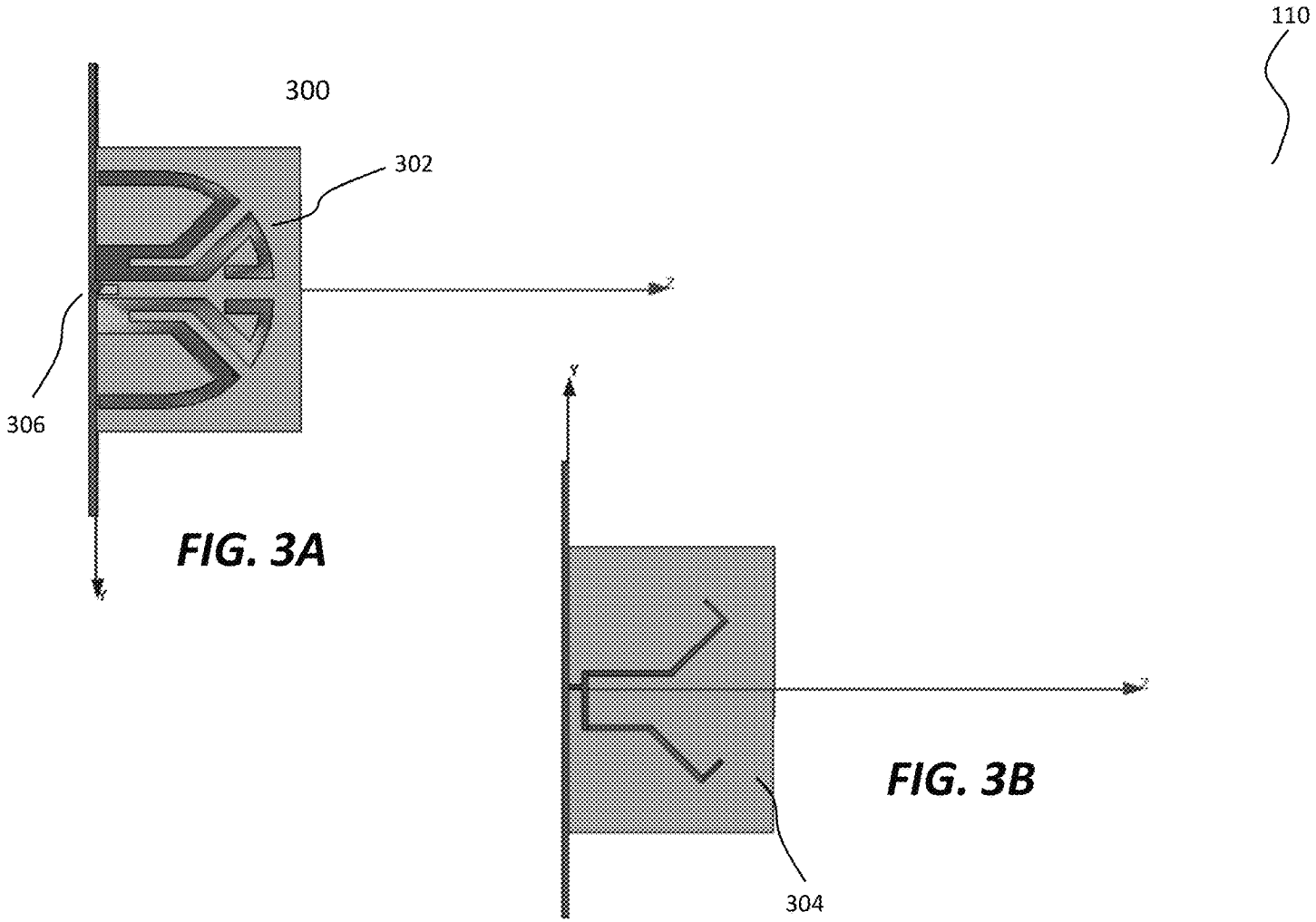
FIG. 3A shows another antenna element according to one embodiment of the present invention.
FIG. 3B shows a back side of a substrate of FIG. 3A, where there is a metal strip formed in a particular pattern to match with the antenna pattern on a front side to provide a desired impedance of the antenna element of FIG. 3A.

Referring now to FIG. 3A, it shows another antenna element 300 according to one embodiment of the present invention. The antenna element 300 is formed on a substrate (e.g., a PCB) and has two sides. On the first side as shown in FIG. 3A, there are metal strips (e.g., copper) formed in a particular pattern 302, two rounded halves 302, each having a metal strip going a certain pattern to form two enclosed loops and one channel between two segments of the metal strip. On the second side of the substrate as shown in FIG. 3B, there is also a metal strip formed in a particular pattern to match with the pattern 302 on the first side to provide a desired impedance. The metal strip on the second side is referred to as a driving or feeding metal trace. It appears to fork after going along a straight line and ends with a 90-degree turn segment. The metal strip on the second side is coupled by a conductor 306 to the first side of the substrate. According to one embodiment, the conductor goes through the substrate.

In one embodiment, the shapes of the copper trace as shown in FIG. 3A and FIG. 3B are so designed that (A) the RF radiating characteristics in both the H-plane and the E-plane of the antenna are substantially similar or identical, where the E-plane is the plane that is in parallel with the substrate and the H-plane is the plane that is perpendicular to the substrate; and (B) the input impedance of the antenna element is optimized to be matched with 50-ohm.

Figure 3C:
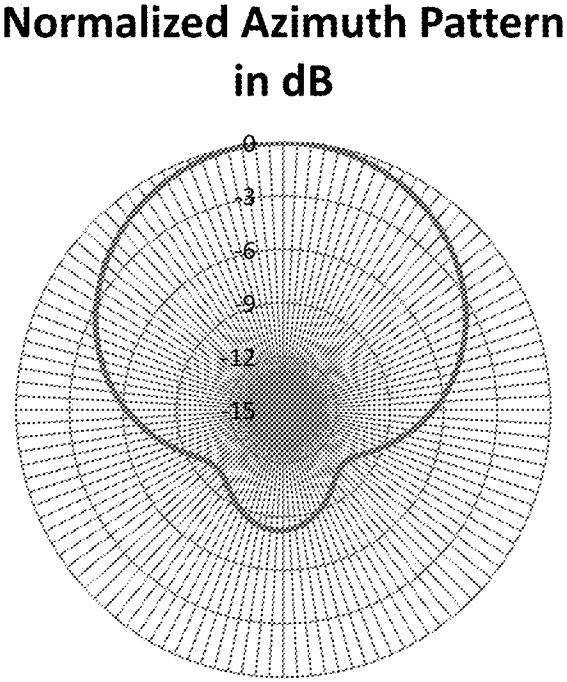
FIG. 3C shows corresponding radiating characteristics of the antenna element in the E-plane.
Figure 3D:
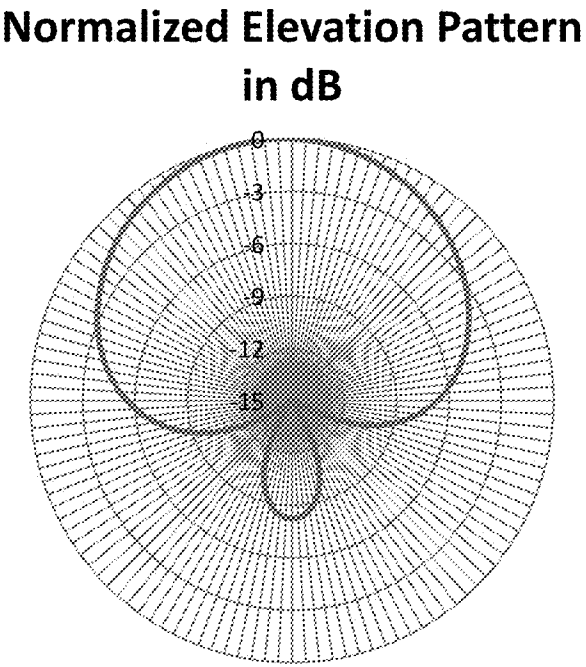
FIG. 3D shows corresponding radiating characteristics of the antenna element in the H-plane.
Figure 3E:
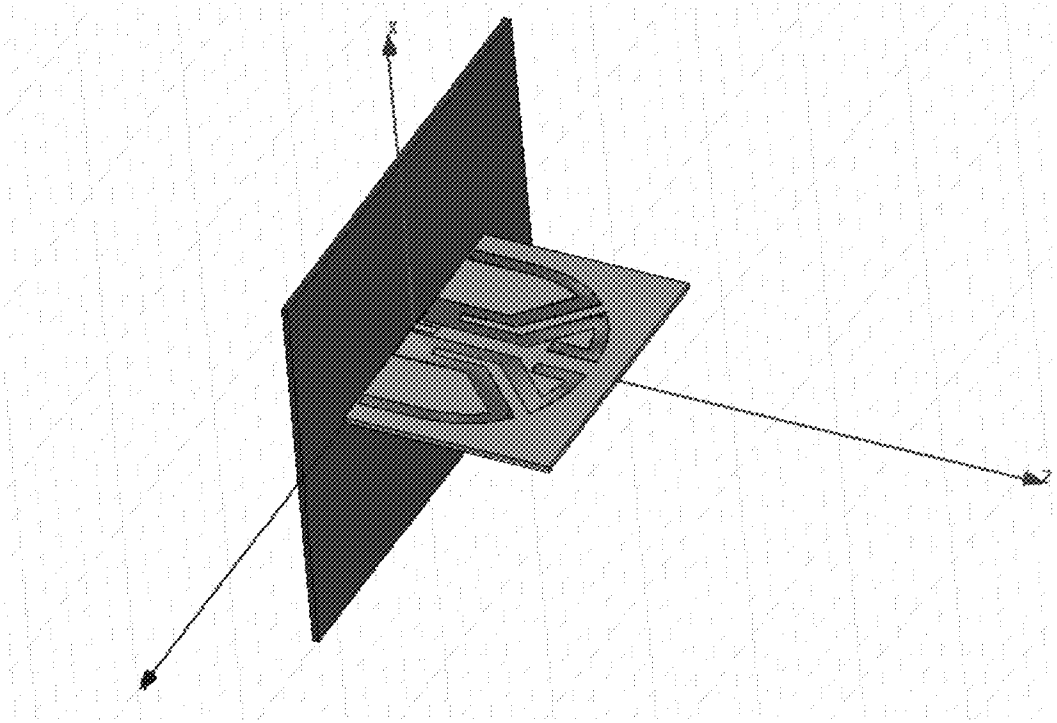
FIG. 3E shows a 3D perspective of the antenna element of FIG. 3A and FIG. 3B.

FIG. 3C shows the radiating characteristics of the antenna element in the E-plane, and FIG. 3D shows the radiating characteristics of the antenna element in the H-plane. FIG. 3E shows a 3D perspective of the antenna element of FIG. 3A and FIG. 3B.

Figure 3G:
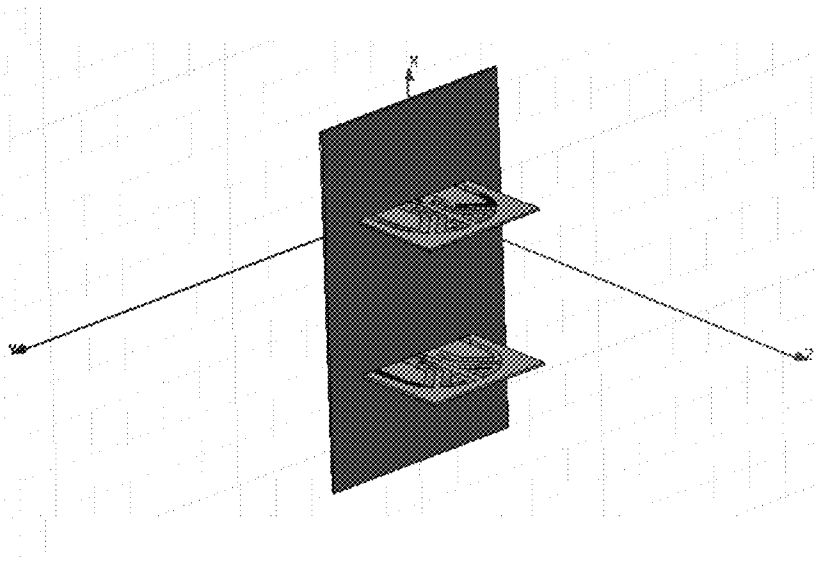
FIG. 3G shows one exemplary antenna unit employing two antenna elements arranged in parallel.
Figure 3F:
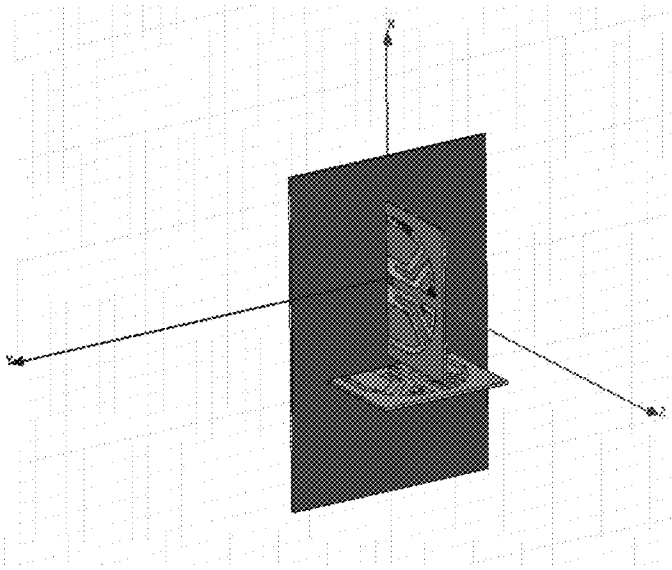
FIG. 3F shows one exemplary antenna unit employing two antenna elements arranged perpendicular to each other.
Figures 3H, 3I:
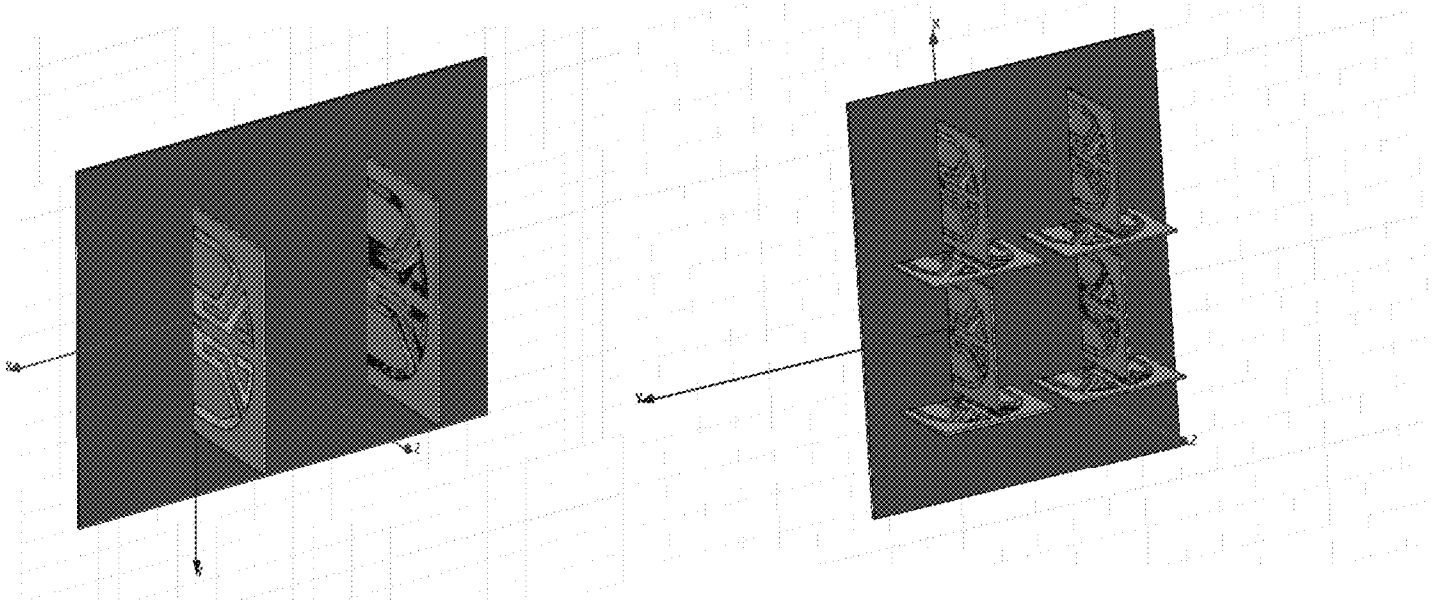
FIG. 3H shows that an antenna unit including two such antenna elements arranged horizontally or next to each other.
FIGS. 3I and 3J show respectively some exemplary structures using more such antenna units.
Figure 3J:
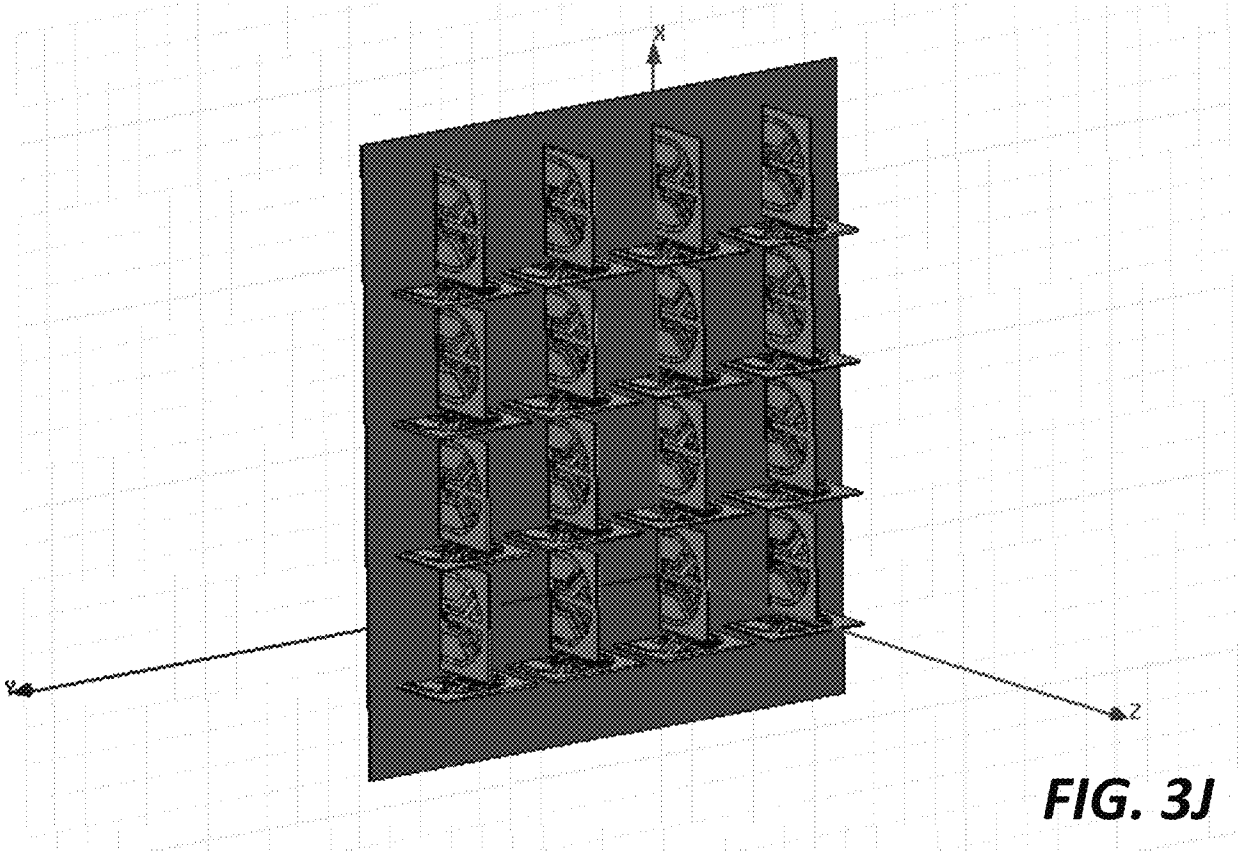

FIG. 3F shows one exemplary antenna unit employing two antenna elements as shown in FIG. 3A and FIG. 3B. The two identical antenna elements are arranged perpendicular to each other as shown in FIG. 3F or vertically (one on top of the other) as shown in FIG. 3G. FIG. 3H shows that two such antenna elements are arranged horizontally or next to each other. Multiple such antenna units may be arranged differently. FIGS. 3I and 3J show respectively some exemplary structures using more such antenna units. Those skilled in the art shall come up with additional structure based on the symmetric arrangement to form different antenna systems given the detailed description of the present invention herein.

Similar to the antenna elements shown in FIG. 1A, in all the possible configurations, the antenna units of FIG. 3F or FIG. 3F can be horizontally or vertically stacked or arrayed to function as one antenna system. According to one embodiment, all the antenna elements that are vertically arranged can be arrayed together and function as one antenna unit, and all the antenna elements that are horizontally arranged can be arrayed together and function as another antenna unit. In any case, the antenna units or arrays are fully independent from each other and provide both vertically polarized and horizontally polarized RF links that have substantially similar main beam radiation characteristics.

Figure 4:
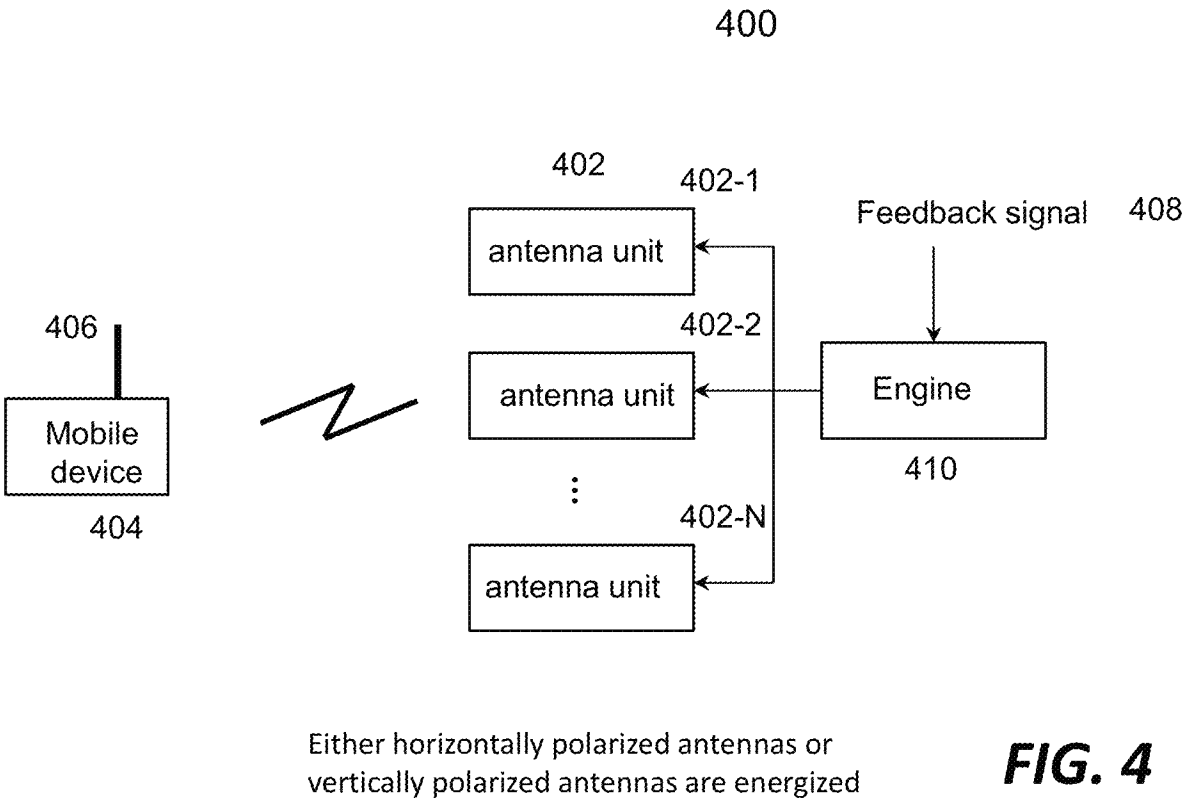
FIG. 4 shows a system block diagram of an antenna system according to one embodiment of the present invention.

FIG. 4 shows a system block diagram of an antenna system 400 used in a device (e.g., a wireless router) according to one embodiment of the present invention. The antenna units 402 may be housed in an enclosure. As shown in FIG. 4, the antenna system 400 includes a plurality of antenna units 402-1, . . . 402-N, where N is a positive integer. As described above, the antenna units 402-1, . . . 402-N are arranged in accordance with a predefined geometry and mounted onto a substrate. Each of the antennas units 402-1, . . . 402-N includes at least two antennas disposed orthogonally with each other or in parallel. In one embodiment, one antenna is a horizontally polarized antenna and the other is a vertically polarized antenna.

When the antenna units 402 are engaged to communicate with a communication device 404 (e.g., a laptop computer), both of the horizontally polarized antennas and the vertically polarized antennas therein are energized to exchange RF signals with the device 404. As the antenna system 400 receives the RF signals via the horizontally polarized antennas or the vertically polarized antennas, it can be configured to detect what type of antenna 406 the device 404 is being equipped with. Without obscuring the aspects of the present instant invention, the details of how to detect the signal strength from an antenna or antennas are not to be provided herein. Those skilled in the art shall know that there are ways to do so.

According to one embodiment, when it is detected that the device 404 is equipped with a horizontally polarized antenna, there is no need to energize the vertically polarized antennas in the antenna units 402. Likewise, when it is detected that the device 404 is equipped with a vertically polarized antenna, there is no need to energize the horizontally polarized antennas in the antenna units 402. It is assumed that the feedback signal 408 is generated from the detection (e.g., through a signal detecting or measuring circuit) indicating which polarized antennas are better to sustain a reliable wireless link between the equipment employing the antenna system 400 and the device 404. Either the horizontally polarized antennas or the vertically polarized antennas are energized by the engine 410.

According to another embodiment, the antenna 406 of the device 404 may not be fully detected as to which of the horizontally polarized antennas and the vertically polarized antennas are better for the wireless link there between. The engine 410 may be configured to partially energize the horizontally polarized antennas while fully energizing the vertically polarized antenna or based on a ratio statically or dynamically determined from the RF signals being exchanged.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claim. Accordingly, the scope of the present invention is defined by the appended claims rather than the forgoing description of embodiments.

We claim:

1. An antenna system comprises:

a substrate; and a plurality of antenna units bonded to the substrate, each of the antenna units including a first printed circuit board and a second printed circuit board, wherein the first and the second printed circuit boards are disposed orthogonally or in parallel, each of the first and the second printed circuit boards includes metal strips etched on a first side thereof according to a first predefined pattern and metal strips etched on a second side thereof according to a second predefined pattern, the metal strips etched on the first side form two independent rounded halves, each of the halves having a metal strip going a certain pattern to form a loop and one channel between two segments of the metal strips, wherein the first side and the second side are coupled by a connector going through the each of the first and the second printed circuit boards.

2. The antenna system as recited in claim 1, wherein the metal strips etched on the second side are provided to match the metal strips etched on the first side to provide a desired impedance.

3. The antenna system as recited in claim 2, wherein the metal strips etched on the second side appear to fork after going along a straight line, each of two strips forked therefrom is ended with a 90-degree turn.

4. The antenna system as recited in claim 1, the antenna units are arranged in a way that the first printed circuit boards in all of the antenna units are in parallel.

5. The antenna system as recited in claim 4, wherein gaps between any two of the antenna units are identical.

6. The antenna system as recited in claim 5, wherein the first printed circuit board in one of the antenna units functions as a horizontally polarized antenna, and the second printed circuit board in the one of the antenna units functions as a vertically polarized antenna.

7. The antenna system as recited in claim 5, wherein the antenna units are functionally independent from each other and provide both vertically polarized and horizontally polarized RF links that have similar main beam radiation characteristics.

8. The antenna system as recited in claim 1, wherein the antenna system is used in a base unit to provide wireless access to one or more wireless devices.

9. The antenna system as recited in claim 1, wherein the antenna units are selectively energized to form a desired antenna pattern.

10. The antenna system as recited in claim 9, wherein the desired pattern is determined in accordance with a signal measured from communication between a device equipped with the antenna system and another device.

11. An antenna system comprises:

a substrate; and a plurality of antenna units arranged in a predefined geometric pattern and bonded to the substrate, each of the antenna units including a horizontally polarized antenna and a vertically polarized antenna, wherein each of the horizontally polarized antenna and the vertically polarized antenna includes a printed circuit with a first side and a second side, the first side includes metal strips etched thereon according to a first predefined pattern, the second side includes metal strips etched thereon according to a second predefined pattern, the metal strips etched on the first side form two rounded halves, each of the halves having a metal strip going a certain pattern to form a loop and one channel between two segments of the metal strips, the first side and the second side is coupled by a connector going through the printed circuit board; and wherein either horizontally polarized antennas or vertically polarized antennas in the antenna units are energized, in accordance with a signal indicating a particular type of antenna a communication device is equipped with, to provide a better wireless link to the communication device communicating with an equipment employing the antenna system.

12. The antenna system as recited in claim 11, wherein the antenna units are arranged in a way that the first printed circuit boards in all of the antenna units are in parallel.

13. The antenna system as recited in claim 12, wherein each of the first and the second printed circuit boards in each of the antenna units has the metal strips etched on both sides thereof.

14. The antenna system as recited in claim 11, wherein the metal strips etched on a second side are provided to match the metal strips etched on the first side to provide a desired impedance.

15. The antenna system as recited in claim 14, wherein the metal strips etched on the second side appear to fork after going along a straight line, each of two strips forked therefrom is ended with a 90-degree turn.

16. The antenna system as recited in claim 11, wherein gaps between any two of the antenna units are identical.

17. The antenna system as recited in claim 11, wherein the first printed circuit board in one of the antenna units functions as a horizontally polarized antenna, and the second printed circuit board in the one of the antenna units functions as a vertically polarized antenna.

18. The antenna system as recited in claim 17, wherein the antenna units are functionally independent from each other and provide both vertically polarized and horizontally polarized RF links that have similar main beam radiation characteristics.

* * * * *